US006803889B2

(12) United States Patent
Onozawa et al.

(10) Patent No.: US 6,803,889 B2
(45) Date of Patent: Oct. 12, 2004

(54) PLASMA DISPLAY DEVICE AND METHOD FOR CONTROLLING THE SAME

(75) Inventors: Makoto Onozawa, Kawasaki (JP); Tomokatsu Kishi, Kawasako (JP); Shigetoshi Tomio, Kawasaki (JP); Tetsuya Sakamoto, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 258 days.

(21) Appl. No.: 09/984,738

(22) Filed: Oct. 31, 2001

(65) Prior Publication Data

US 2002/0097203 A1 Jul. 25, 2002

(30) Foreign Application Priority Data

Jan. 19, 2001 (JP) ..... 2001-012418

(51) Int. Cl.[7] ..... G09G 3/28
(52) U.S. Cl. ..... 345/60; 345/62; 345/211
(58) Field of Search ..... 345/60–72, 76, 345/211, 212; 315/169.1–169.4

(56) References Cited

U.S. PATENT DOCUMENTS 4,914,353 A * 4/1990 Harada et al. ..... 315/169.3
5,616,988 A * 4/1997 Kim ..... 315/1
5,627,556 A * 5/1997 Kwon et al. ..... 345/76
6,281,633 B1 * 8/2001 Lee et al. ..... 315/169.1
6,496,166 B1 * 12/2002 Onozawa et al. ..... 345/60

FOREIGN PATENT DOCUMENTS

| | | | |
|---|---|---|---|
| EP | 1 065 650 A2 | | 1/2001 |
| JP | 48-91933 | | 11/1973 |
| JP | 54-064426 | * | 5/1979 |
| JP | 4-181809 | | 6/1992 |
| JP | 7-191623 | | 7/1995 |
| JP | 08-234695 | * | 9/1996 |
| JP | 8-320667 | | 12/1996 |
| JP | 10-268830 | * | 10/1998 |
| JP | 11-143427 | | 5/1999 |
| JP | 11-296136 | * | 10/1999 |
| JP | 11-344948 | * | 12/1999 |
| JP | 2000-181401 | | 6/2000 |
| JP | 2000-235364 | * | 8/2000 |

* cited by examiner

*Primary Examiner*—Regina Liang
(74) *Attorney, Agent, or Firm*—Staas & Halsey LLP

(57) ABSTRACT

A signal transfer circuit in a pre-drive circuit converts the reference potential of a control signal, supplied from a drive control circuit, to the reference potential of an output element. The control signal is then amplified in a signal amplifier circuit and thereafter supplied to the output element. This makes it possible to isolate the reference potential and transfer the control signal to the output element even when the reference potentials of the drive control circuit and the control signal are different from that of the output element. The drive control circuit can also be prevented from being affected by variations in potential of the output element or the like.

13 Claims, 15 Drawing Sheets

PLASMA DISPLAY DEVICE AND METHOD FOR CONTROLLING THE SAME

CROSS-REFERENCE TO RELATED APPLICATIONS

This application is based upon and claims priority of Japanese Patent Application No. 2001-012418, filed on Jan. 19, 2001, the contents being incorporated herein by reference.

BACKGROUND OF THE INVENTION

1. Field of the Invention

The present invention relates to plasma display device and methods for controlling the plasma display device. More particularly, the present invention relates to a plasma display device and a method for controlling the plasma display device which are preferably employed for an AC-driven plasma display device having different reference potentials between the drive circuit for driving each of the cells constituting the display portion and the drive control circuit for controlling the drive circuit.

2. Description of the Related Art

Conventionally, AC-driven plasma display panels (PDPs), one of flat display panels, are classified into two-electrode type PDPs which perform selective discharge (address discharge) and sustain discharge using two electrodes and three-electrode type PDPs which perform address discharge using a third electrode. The three-electrode type PDPs are further classified into a type with the third electrode formed on a substrate on which the first and second electrodes for performing sustain discharge are laid out and a type with the third electrode formed on another substrate opposite to the substrate of the first and second electrodes.

All types of the above PDP devices are based on the same operation principle. The arrangement of a PDP device in which the first and second electrodes for performing sustain discharge are formed on the first substrate, and the third electrode is formed on the second substrate opposite to the first substrate will be described below.

FIG. 17 is a view showing the overall arrangement of an AC-driven PDP device. In the AC-driven PDP device 1 shown in FIG. 17, a plurality of cells each corresponding to one pixel of a display image are arrayed in a matrix. FIG. 17 shows an AC-driven PDP device having cells arrayed in a matrix with m rows by n columns. The AC-driven PDP 1 also has scanning electrodes Y1 to Yn and common electrodes X, which are formed to run parallel on the first substrate, and address electrodes A1 to Am which are formed on the second substrate opposite to the first substrate so as to run perpendicular to the electrodes Y1 to Yn and X. The common electrodes X are formed in proximities of the scanning electrodes Y1 to Yn in correspondence with them and commonly connected at terminals on one side.

The common terminal of the common electrodes X is connected to the output terminal of an X-side circuit 2. The scanning electrodes Y1 to Yn are connected to the output terminals of a Y-side circuit 3. The address electrodes A1 to Am are connected to the output terminals of an address-side circuit 4. The X-side circuit 2 is formed from a circuit for repeating discharge. The Y-side circuit 3 is formed from a circuit for executing line-sequential scanning and a circuit for repeating discharge. The address-side circuit 4 is formed from a circuit for selecting a column to be displayed.

The X-side circuit 2, Y-side circuit 3, and address-side circuit 4 are controlled by control signals supplied from a drive control circuit 5. That is, a cell to be turned on is determined by the address-side circuit 4 and the line-sequential scanning circuit in the Y-side circuit 3, and discharge is repeated by the X-side circuit 2 and Y-side circuit 3, thereby performing the display operation of the PDP.

The drive control circuit 5 generates the control signals on the basis of display data D from an external device, a clock CLK indicating the read timing of the display data D, a horizontal sync signal HS, and a vertical sync signal VS and supplies the control signals to the X-side circuit 2, Y-side circuit 3, and address-side circuit 4.

FIG. 18A is a sectional view of a cell Cij as a pixel, which is in the ith row and jth column. Referring to FIG. 18A, the common electrode X and the scanning electrode Yi are formed on a front glass substrate 11. The electrodes X and Yi are coated with a dielectric layer 12 that insulates the electrodes from discharge space 17. The dielectric layer 12 is coated with an MgO (magnesium oxide) protective film 13.

On the other hand, the address electrode Aj is formed on a back glass substrate 14 opposite to the front glass substrate 11. The address electrode Aj is coated with a dielectric layer 15, and the dielectric layer 15 is coated with a phosphor 18. Ne+Xe Penning gas is sealed in the discharge space 17 between the MgO protective film 13 and the dielectric layer 15.

FIG. 18B is a view for explaining the capacitance Cp in the AC-driven PDP. As shown in FIG. 18B, in the AC-driven PDP, capacitive components Ca, Cb, and Cc are present in the discharge space 17, between the common electrode X and the scanning electrode Y, and in the front glass substrate 11, respectively. A capacitance Cpcell per cell is determined by the sum of the capacitive components (Cpcell=Ca+Cb+Cc). The sum of capacitances Cpcell of all the cells in the panel is the panel capacitance Cp.

FIG. 18C is a view for explaining light emission of an AC-driven PDP. As shown in FIG. 18C, striped-shaped red, blue, and green phosphors 18 are laid out and applied to the inner surface of ribs 16. The phosphors 18 are excited by discharge between the common electrode X and the scanning electrode Y so as to emit light.

In addition, a method for driving an AC-driven PDP has been suggested. The method employs a drive circuit as shown in FIG. 19 to apply a positive potential to one electrode and a negative potential to the other electrode, thereby making use of a potential difference between the electrodes to perform discharge therebetween.

FIG. 19 is a circuit diagram showing the arrangement of a drive circuit for an AC-driven PDP.

Referring to FIG. 19, a capacitive load 20 (hereinafter referred to as a "load") is the total capacitance of the cells formed between one common electrode X and one scanning electrode Y. The common electrode X and the scanning electrode Y are formed on the load 20. Here, the scanning electrode Y is a given scanning electrode of the scanning electrodes Y1 to Yn.

On the common electrode X side, switches SW1 and SW2 are connected in series between the ground (GND) and a power supply line for a potential (Vs/2) supplied from a power supply (not shown). One terminal of a capacitor C1 is connected to an interconnection node between the two switches SW1 and SW2, while a switch SW3 is connected between the other terminal of the capacitor C1 and the GND.

Switches SW4 and SW5 are connected in series between the two terminals of the capacitor C1. An interconnection node between the two switches SW4 and SW5 is connected on the way to the common electrode X of the load 20 via an output line OUTC and to a power recovery circuit 21 as well. Furthermore, a switch SW6 having a resistor R1 is connected between a second signal line OUTB and a power supply line for generating a write potential Vw.

The power recovery circuit 21 has two coils L1 and L2 connected to the load 20, a diode D2 and a transistor Tr1 that are connected in series to the coil L1, and a diode D3 and a transistor Tr2 that are connected in series to the coil L2. The power recovery circuit 21 also has a capacitor C2 to be connected between the interconnection node of the two transistors Tr1 and Tr2 and the second signal line OUTB.

Thus, the load 20 and the coils L1 and L2 each connected thereto constitute two resonant circuits. That is, the power recovery circuit 21 is provided with two L-C resonant circuits in which charges supplied to the panel by the resonance of the coil L1 and the load 20 are recovered through the resonance of the coil L2 and the load 20.

On the scanning electrode Y side, switches SW1' and SW2' are connected in series between the ground (GND) and a power supply line for a potential (Vs/2) supplied from a power supply (not shown). One terminal of a capacitor C4 is connected to an interconnection node of the two switches SW1' and SW2', while a switch SW3' is connected between the other terminal of the capacitor C4 and the GND.

Switch SW4' connected to the one terminal of the capacitor C4 is connected to the cathode of the diode D7, and the anode of the diode D7 is connected to the other terminal of the capacitor C4. Switch SW5' connected to the other terminal of the capacitor C4 is connected to the anode of the diode D6, and the cathode of the diode D6 is connected to the one terminal of the capacitor C4.

Moreover, one terminal of the switch SW4' connected to the cathode of the diode D7 and one terminal of the switch SW5' connected to the anode of the diode D6 are connected with the load 20 via a scan driver 22 and a power recovery circuit 21' as well. Furthermore, a switch SW6' having a resistor R1' is connected between a fourth signal line OUTB' and the power supply line for generating a write potential Vw.

The power recovery circuit 21' has two coils L3 and L4 connected to the load 20 via the scan driver 22, a diode D4 and a transistor Tr3 that are connected in series to the coil L3, and a diode D5 and a transistor Tr4 that are connected in series to the coil L4. The power recovery circuit 21' also has a capacitor C3 to be connected between the common terminal of the two transistors Tr3 and Tr4 and the fourth signal line OUTB'.

The power recovery circuit 21' is also provided with two L-C resonant circuits in which charges supplied to the load 20 by the resonance of the coil L4 and the load 20 are recovered through the resonance of the coil L3 and the load 20.

In addition to the configuration, there are also provided three transistors Tr5, Tr6, and Tr7 and two diodes D6 and D7 on the scanning electrode Y side. When turned on, the transistor Tr5 allows a resistor R2 connected thereto to act to blunt the waveform of a pulse potential applied to the scanning electrode Y. The transistor Tr5 and the resistor R2 are connected in parallel to the switch SW5'.

The transistors Tr6 and Tr7 are adapted to provide a potential difference (Vs/2) across the scan driver 22 in an address period, which is described later. That is, in the address period, the switch SW2' and the transistor Tr6 are turned on, thereby causing the potential at the upper side of the scan driver 22 to reach the ground level. Moreover, the transistor Tr7 is turned on to thereby cause the negative potential (−Vs/2) outputted to the fourth signal line OUTB' in accordance with the charges accumulated in the capacitor C4 to be applied to the lower side of the scan driver 22. Upon outputting a scan pulse, this makes it possible to allow the scan driver 22 to apply the negative potential (−Vs/2) to the scanning electrode Y.

The switches SW1 to SW6, SW1' to Sw6' and the transistors Tr1 to Tr7 are controlled by control signals supplied from a drive control circuit 31. The drive control circuit 31 comprises logic circuits, and generates the control signals on the basis of display data D from an external device, a clock CLK, a horizontal sync signal HS, and a vertical sync signal VS to then supply the control signals to the switches SW1 to SW6, SW1' to Sw6' and the transistors Tr1 to Tr7.

Incidentally, FIG. 19 shows control lines connected the drive control circuit 31 with the switches SW4, SW5, SW4', and SW5' and the transistors Tr1 to Tr4. However, there also exist control lines that connect the drive control circuit 31 with the switches SW1 to SW6, SW1' to SW6' and the transistors Tr1 to Tr7.

FIG. 20 is a timing chart showing drive waveforms provided by the drive circuit for the AC-driven PDP configured as shown in FIG. 19. FIG. 20 shows one of a plurality of subfields of one frame. One subfield is divided into a reset period comprised of a full write period and a full erase period, an address period, and a sustain discharge period.

In FIG. 20, in the reset period, first, on the common electrode X side, the switches SW2 and SW5 are turned on and the switches SW1, SW3, SW4, and SW6 are turned off. This causes the potential of the second signal line OUTB to be reduced down to (−Vs/2) in accordance with the charges accumulated in the capacitor C1. Then, the potential (−Vs/2) is output to the output line OUTC through the switch SW5 and then applied to the common electrode X of the load 20.

On the scanning electrode Y side, the switches SW1', SW4', and SW6' are turned on and the switches SW2', SW3', and SW5' are turned off. This causes the potential Vw added by a potential (Vs/2) resulting from the charges accumulated in the capacitor C4 to be applied to the output line OUTC'. Then, the potential (Vs/2+Vw) is applied to the scanning electrode Y of the load 20. At this time, the resistor R1' in the switch SW6' acts to gradually increase the potential with the passage of time.

This causes the potential difference between the common electrode X and the scanning electrode Y to reach (Vs+Vw), and discharge to be performed in all cells of all display lines independently of the preceding display state, thereby forming wall charges (full writing).

Then, each switch is controlled as appropriate to bring the potential of the common electrode X and the scanning electrode Y back to the ground level, and then a state opposite to the state is created on the common electrode X and the scanning electrode Y. That is, on the common electrode X side, the switches SW1, SW4, and SW6 are turned on, and the switches SW2, SW3, and SW5 are turned off, while on the scanning electrode Y side, the switches SW2' and SW5' are turned on, and the switches SW1', SW3', SW4', and SW6' are turned off.

This allows the potential applied to the common electrode X to increase continuously from the ground level up to (Vs/2+Vw) with the passage of time, while the potential applied to the scanning electrode Y drops down to (−Vs/2). This causes the potential of wall charges themselves to exceed the discharge start potential in all the cells, thereby starting discharge. At this time, as described above, by allowing the potential applied to the common electrode X to continuously increase as time goes by, weak discharge is performed to erase the accumulated wall charges excluding a part thereof (full erasing).

Then, in the address period, address discharge is line-sequentially performed to turn on/off each cell in accordance with the display data. At this time, on the common electrode X side, the switches SW1, SW3, and SW4 are turned on, and the switches SW2, SW5, and SW6 are turned off. The potential of the first signal line OUTA is thereby raised up to the potential (Vs/2) that is provided via the switch SW1. Then, the potential (Vs/2) is outputted to the output line OUTC through the switch SW4 and applied to the common electrode X of the load 20.

In addition, upon the application of a potential to a scanning electrode Y corresponding to a given display line, the switch SW2' and the transistor Tr6 are turned on, thereby causing the potential at the upper side of the scan driver 22 to be brought down to the ground level. Moreover, the transistor Tr7 is turned on, thereby causing the negative potential (−Vs/2) outputted to the fourth signal line OUTB' in accordance with the charges accumulated in the capacitor C4 to be applied to the lower side of the scan driver 22. Accordingly, a potential level of (−Vs/2) is applied to the scanning electrodes Y selected line-sequentially, while the ground level potential is applied to non-selected scanning electrodes Y of the load 20.

At this time, an address pulse having a potential Va is selectively applied to the address electrode Aj in the address electrode A1 to Am, which corresponds to a cell which should cause sustain discharge, i.e., a cell to be turned on. As a result, discharge occurs between the address electrode Aj of the cell to be turned on and the line-sequentially selected scanning electrode Y. With this priming (pilot flame), discharge between the common electrode X and the scanning electrode Y immediately starts. Wall charges in an amount enough for the next sustain discharge are accumulated on the MgO protective film on the common electrode X and scanning electrode Y of the selected cell.

Then, in the sustaining discharge period, the two switches SW1 and SW3 are first turned on, and the remaining switches SW2, and SW4 to SW6 are turned off on the common electrode X side. At this time, the potential of the first signal line OUTA reaches (+Vs/2) and the second signal line OUTB reaches the ground level. Here, the transistor Tr1 in the power recovery circuit 21 is turned on to thereby allow the coil L1 and the capacitance of the load 20 to produce L-C resonance, and the charges that have been recovered in the capacitor C2 is supplied to the load 20 through the transistor Tr1, the diode D2, and the coil L1.

At this time, on the scanning electrode Y side, the switch SW2' has been turned on. Accordingly, the current supplied from the capacitor C2 to the common electrode X via the switch SW3 on the common electrode X side passes through the diode in the scan driver 22 on the scanning electrode Y side and the diode D6 to be supplied to the GND via the third signal line OUTA' and the switch SW2'. The current flowing as described above causes the potential of the common electrode X to increase gradually as shown in FIG. 20. Then, the switch SW4 is turned on near the peak potential produced upon the resonance, thereby the potential of the common electrode X is clamped to the potential (Vs/2).

Subsequently, on the scanning electrode Y side, the transistor Tr3 in the power recovery circuit 21' is further turned on. This allows the coil L3 and the capacitance of the load 20 to produce L-C resonance. A current is supplied to the common electrode X from the switch SW3 and the capacitor C1 on the common electrode X side through the first signal line OUTA, and the switch SW4. The current passes through the diode in the scan driver 22 on the scanning electrode Y side and the diode D4 in the power recovery circuit 21' and is then supplied to the GND via the transistor Tr3, the capacitor C3, the capacitor C4, and the switch SW2'. The current flowing as described above causes the potential of the scanning electrode Y to decrease gradually as shown in FIG. 20. At this time, part of the charges can be recovered in the capacitor C3. Then, the switch SW5' is also turned on near the peak potential produced upon the resonance, whereby the potential of the scanning electrode Y is clamped to the potential (−Vs/2).

Similarly, to change the potential applied to the common electrode X and the scanning electrode Y from the potential (−Vs/2) to the ground level (0V), the charges that have been recovered in the capacitors C2 and C3 in the power recovery circuits 21 and 21' is supplied, thereby allowing the applied potential to gradually increase.

In addition, to change the potential applied to the common electrode X and the scanning electrode Y from the potential (Vs/2) to the ground level (0V), the charges that have been accumulated in the load 20 is supplied to the GND, thereby allowing the applied potential to gradual
ly decrease and a part of the charges that have been accumulated in the load 20 to be recovered in the capacitors C2 and C3 in the power recovery circuits 21 and 21'.

As described above, in the sustain discharge period, potentials (+Vs/2 and −Vs/2) different in polarity from each other are applied alternately to the common electrode X and the scanning electrode Y of each display line to perform sustain discharge to thereby display one subfield of image.

In the drive circuit for the AC-driven PDP, the drive control circuit 31 comprised logic circuits or the like employs the GND level as a reference potential. However, during the drive operation, the reference potential of output elements varies to which control signals are supplied from the drive control circuit 31 and by which potentials are supplied to the common electrode X and the scanning electrode Y. Here, meant by the output elements are the switches SW4, SW5, SW4', and SW5', and the transistors Tr1 to Tr4 in the power recovery circuits 21 and 21'. For this reason, a variation in potential of the output elements could produce backflow of power to the drive control circuit 31, thereby causing a high potential to be applied to the drive control circuit 31, for example, upon supplying the signal generated by the drive control circuit 31 to the output elements.

As a method for solving this problem, such a method can be contemplated in which components having a high breakdown potential are employed as the elements in the output portion of the drive control circuit 31 to thereby prevent the effects caused by the variations in potential of the output elements. However, there was a problem that the output portion of the drive control circuit 31 configured using components having a high breakdown potential made the circuit complicated.

Furthermore, in the drive circuit for the AC-driven PDP, suppose that the power recovery circuits 21 and 21' work improperly, that is, potentials across the capacitors C2 and C3 deviate from normal potentials. In this case, output loss would become greater in the drive operation of the drive circuit to cause each of the elements constituting the drive circuit to generate a greater amount of heat, thereby leading to damage to the elements in some cases.

SUMMARY OF THE INVENTION

The present invention was developed to solve such a problem. It is therefore an object of the present invention to provide a highly reliable plasma display device without employing components or the like having a high breakdown potential.

In addition, it is a second object of the present invention to make it possible to prevent damage to the elements when the power recovery circuit works improperly.

The plasma display device according to an aspect of the present invention is characterized by comprising a signal transfer circuit. The signal transfer circuit converts a control signal, for controlling an output element for supplying a potential to an electrode provided for applying a potential to a display cell and producing discharge therein, to a signal having a reference potential of the output element and then supplies the resulting signal to the output element.

The plasma display device according to another aspect of the present invention is characterized by lowering a power supply potential for driving the plasma display device when a power recovery potential detected by the potential detector circuit for detecting the power recovery potential of a power recovery circuit is different from a power recovery potential indicative of the properly operating power recovery circuit.

According to the present invention configured as described above, a control signal for controlling an output element for supplying a potential to an electrode is converted to a signal having the reference potential of the output element and the resulting signal is then supplied to the output element. This makes it possible to transfer the control signal, with the reference potential being isolated. Accordingly, the side for supplying the control signal could be prevented from being affected by variations in potential of the output element or the like.

Furthermore, according to anther aspect of the present invention, the power recovery potential of the power recovery circuit is detected. When the power recovery potential detected is different from a power recovery potential indicative of the properly operating power recovery circuit, the power supply potential for driving the plasma display device is lowered. This makes it possible to stop the operation of the plasma display device before the occurrence of damage to the elements.

DETAILED DESCRIPTION OF THE PREFERRED EMBODIMENTS

Now, the present invention will be explained below with reference to the accompanying drawings in accordance with the embodiments.

[First Embodiment]

Figure 1:
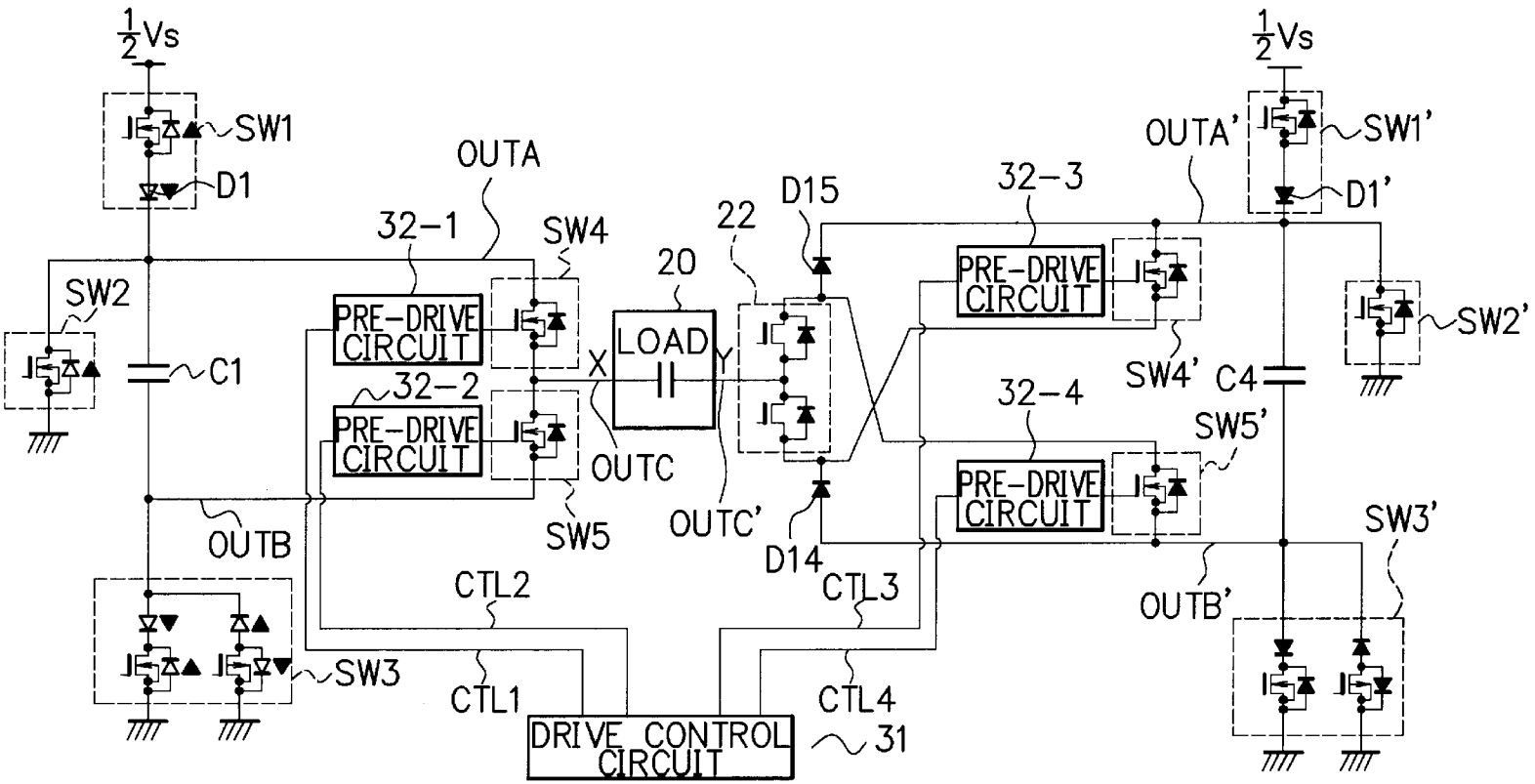
FIG. 1 is a circuit diagram showing the arrangement of a drive circuit for an AC-driven PDP according to the first embodiment.
Figure 17:
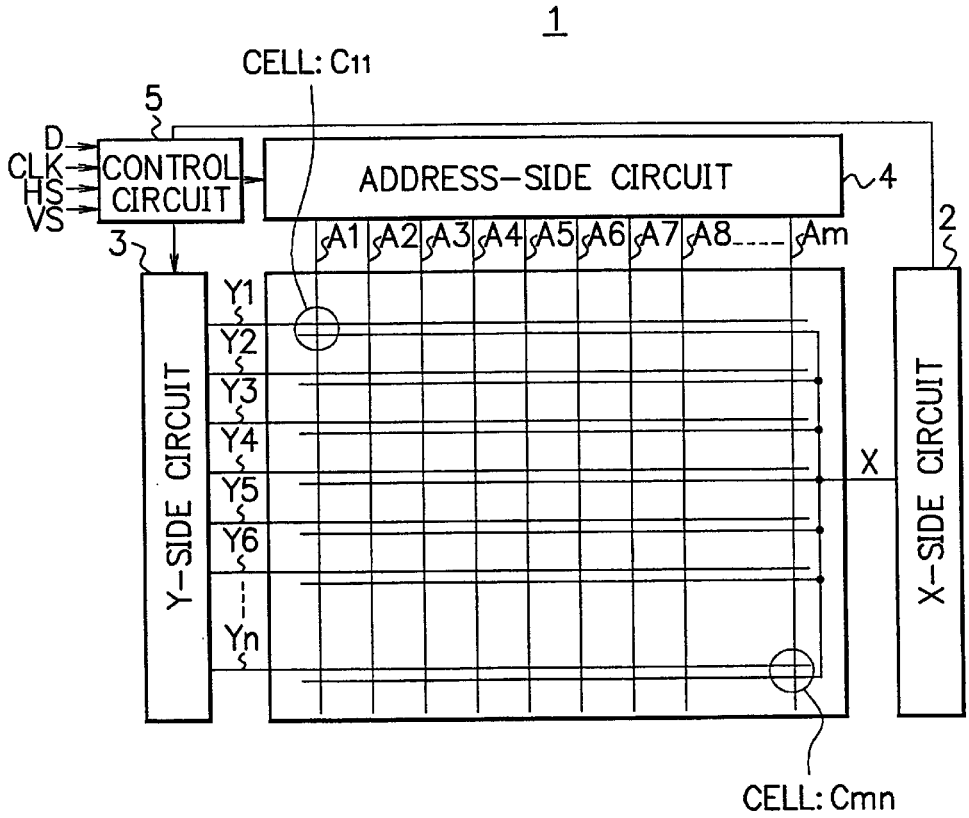
F I G. 17 PRIOR ART
FIG. 17 is a view showing the overall arrangement of an AC-driven PDP.
Figure 18A:
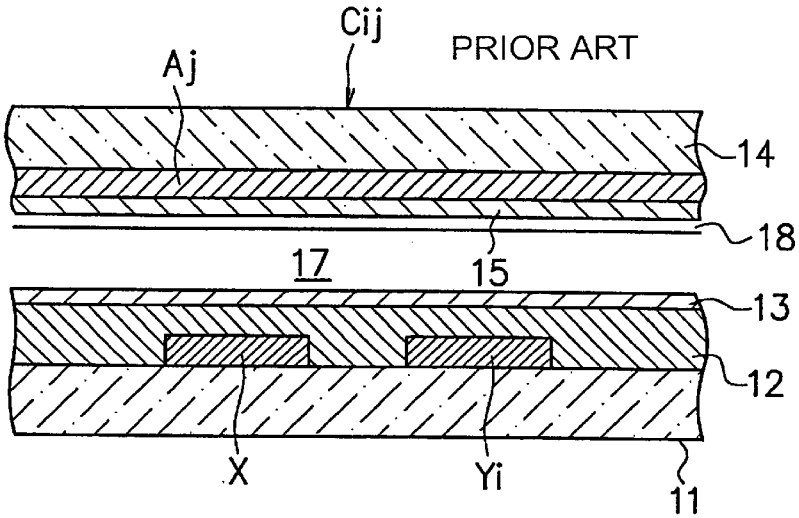
FIG. 18A is a sectional view showing a sectional structure of a cell Cij as a pixel, which is in the ith row and jth column.
Figure 18B:
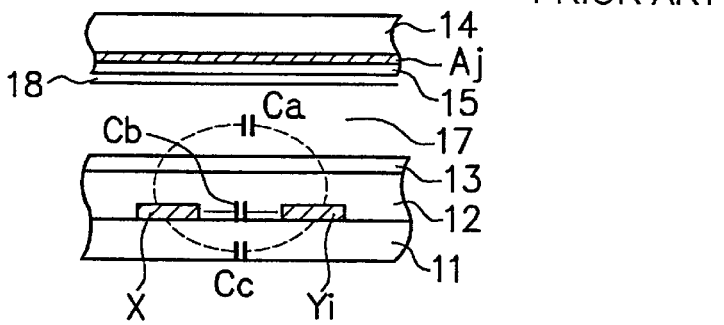
FIG. 18B is a view for explaining the capacitance of an AC-driven PDP.
Figure 18C:
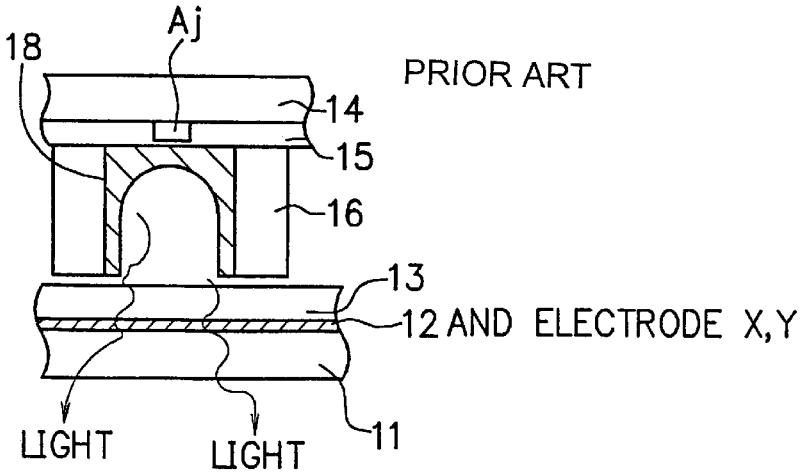
FIG. 18C is a view for explaining light emission of an AC-driven PDP.

FIG. 1 is a circuit diagram showing the arrangement of a drive circuit for an AC-driven PDP according to a first embodiment. Incidentally, the drive circuit shown in FIG. 1 according to this embodiment is applicable to the AC-driven PDP shown in FIGS. 17 and 18, in which illustrated are the overall arrangement thereof and the structure of a cell constituting the pixel. It is to be understood that the components having the same reference symbol in FIGS. 1 and 19 have the same function.

Referring to FIG. 1, the load 20 is the total capacitance of the cells formed between one common electrode X and one scanning electrode Y. The common electrode X and the scanning electrode Y are formed on the load 20.

On the common electrode X side, the switches SW1 and SW2 are connected in series between the power supply line for the potential (Vs/2) supplied from a power supply (not shown) and the ground (GND). One terminal of the capacitor C1 is connected to an interconnection node of the two switches SW1 and SW2, while the switch SW3 is connected between the other terminal of the capacitor C1 and the GND.

Switches SW4 and SW5 are connected in series between the two terminals of the capacitor C1. The SW4 is connected to the one terminal of the capacitor C1 via the first signal line OUTA, while the SW5 is connected to the other terminal of the capacitor C1 via the second signal line OUTB. An interconnection node between the two switches SW4 and SW5 is connected with the common electrode X of the load 20 via the output line OUTC.

On the scanning electrode Y side, switches SW1' and SW2' are connected in series between the power supply line for the potential (Vs/2) supplied from a power supply (not shown) and the ground (GND). One terminal of the capacitor C4 is connected to an interconnection node of two switches SW1' and SW2', while the switch SW3' is connected between the other terminal of the capacitor C4 and the GND.

In addition, the switch SW4' connected to the one terminal of the capacitor C4 via the third signal line OUTA' is connected to the cathode of a diode D14, and the anode of the diode D14 is connected to the other terminal of the capacitor C4. The switch SW5' connected to the other terminal of the capacitor C4 via the fourth signal line OUTB' is connected to the anode of a diode D15, and the cathode of the diode D15 is connected to the one terminal of the capacitor C4. Moreover, one terminal of the switch SW4' connected to the cathode of the diode D14 and one terminal of the switch SW5' connected to the anode of the diode D15 are connected with the scanning electrode Y of the load 20 via the scan driver 22.

Incidentally, FIG. 1 shows only one scan driver 22, however, one scan driver 22 is provided for each of a plurality of display lines of the PDP. Other circuits serve as a common circuit provided in common for a plurality of display lines.

The drive control circuit 31 comprises logic circuits or the like and controls the switches SW1 to SW5 and SW1' to SW5' which constitute the drive circuit. That is, the drive control circuit 31 generates control signals for controlling the switches SW1 to SW5 and SW1' to SW5' on the basis of display data from an external device, a clock, a horizontal sync signal, a vertical sync signal or the like. Then, the drive control circuit 31 supplies the control signals generated as such to each of the switches SW1 to SW5 and SW1' to SW5'.

Incidentally, as for control lines for supplying control signals from the drive control circuit 31, illustrated in FIG. 1 are only control lines CTL1 to CTL4 for supplying control signals to pre-drive circuits 32-1, 32-2, 32-3, 32-4, each connected to each of the switches SW4, SW5, SW4', and SW5'. However, a control line for supplying a control signal from the drive control circuit 31 is connected to each of the switches SW1 to SW3 and SW1' to SW3'.

The pre-drive circuits 32-1 to 32-4 supply control signals. Each of the control signals is supplied from the drive control circuit 31 via the control lines CTL1 to CTL4, employing the reference potential (e.g., the GND) of the drive control circuit 31 as the reference. Upon supplying the control signals, the potential level thereof is converted to match with the reference potential of the switches SW4, SW5, SW4', and SW5'. Incidentally, the pre-drive circuits 32-1 to 32-4 are described later in more detail.

Now, the operation is explained with reference to FIG. 2.

Figure 2:
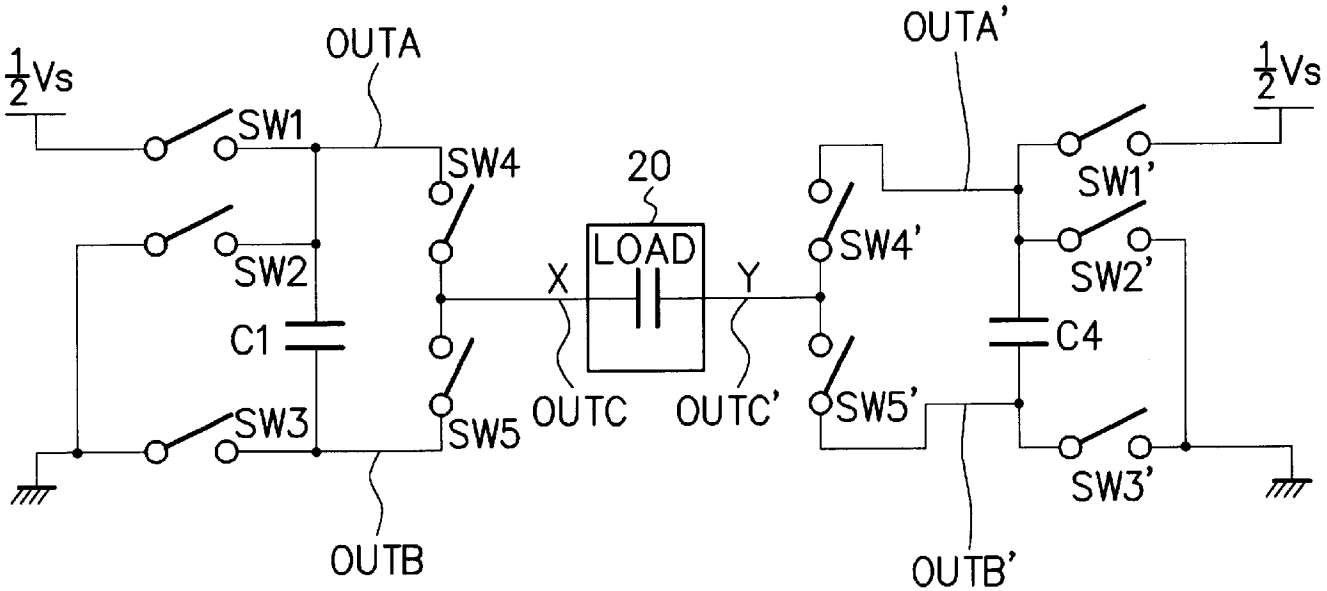
FIG. 2 is a conceptual view for explaining the operation of the drive circuit for the AC-driven PDP according to the first embodiment.

FIG. 2 is a conceptual view for explaining the operation of the drive circuit for the AC-driven PDP shown in FIG. 1. Incidentally, in FIG. 2, the components having the same reference symbols as those shown in FIG. 1 have the same function, and a repetitive description will be omitted.

Referring to FIG. 2, on the common electrode X side, the two switches SW1 and SW3 are turned on, and the remaining switches SW2, SW4, and SW5 are turned off. This causes the potential of the first signal line OUTA to reach the potential (+Vs/2), which is supplied from a power supply (not shown) via the switch SW1. Thereafter, the switch SW4 is turned on and the switches SW4' and SW2' on the scanning electrode Y side are turned on. This causes the potential (+Vs/2) of the first signal line OUTA to be applied to the common electrode X of the load 20 via the output line OUTC and the potential (Vs/2) to be thereby applied between the common electrode X and the scanning electrode Y.

In addition, at this stage, the switches SW1 and SW3 are turned on to cause the capacitor C1 to be connected to the power supply. Accordingly, the capacitor C1 is provided with charges accumulated therein in accordance with the potential (Vs/2) applied by a power supply (not shown) via the switches SW1 and SW3.

Subsequently, the switch SW4 is turned off to shut off the current path for applying the potential. Thereafter, the switch SW5 is turned on under pulsed operation, thereby reducing the potential of the output line OUTC down to the ground level. Then, the switch SW2 is turned on, the remaining four switches SW1, SW3, SW4, and SW5 are turned off, and thereafter the switch SW4 is turned on under pulsed operation. The switch SW4 is turned on, thereby providing the common electrode X (the ground) with a current path for applying a potential to the scanning electrode Y side.

Then, with the switch SW2 remaining turned on, the switch SW5 is turned on. At this time, the first signal line OUTA is not supplied with the power supply potential from a power supply (not shown) via the switch SW1 and will be therefore provided with the ground level potential. On the other hand, the switch SW2 is turned on to cause the first signal line OUTA to be grounded. Accordingly, the second signal line OUTB will be provided with the potential (−Vs/2), which is lowered from the ground level by the potential (Vs/2) in accordance with the charges accumulated in the capacitor C1.

At this time, since the switch SW5 has been turned on, the potential (−Vs/2) of the second signal line OUTB is applied to the load 20 via the output line OUTC. At this time, the switches SW3' and SW4' on the scanning electrode Y are turned on, thereby applying the potential (−Vs/2) to the common electrode X side with respect to the scanning electrode Y (at potential Vs/2).

Then, the switches SW2 and SW4 are turned on, and the remaining switches SW1, SW3, and SW5 are turned off. This raises the potential of the output line OUTC to the ground level. Thereafter, like the first stage, the three switches SW1, SW3, and SW4 are turned on, and the remaining two switches SW2 and SW5 are turned off, which will be repeated from then on in the same way.

As described above, the positive potential (+Vs/2) and the negative potential (−Vs/2) are alternately applied to the common electrode X of the load 20. On the other hand, by the same switching control as that for the common electrode X side, the positive potential (+Vs/2) and the negative potential (−Vs/2) are alternately applied also to the scanning electrode Y of the load 20.

At this time, the potentials (+/−Vs/2) applied to each of the common electrode X and the scanning electrode Y have phases inverted relative to each other. That is, when the positive potential (+Vs/2) is applied to the common electrode X, the negative potential (−Vs/2) is applied to the scanning electrode Y. By this, the potential difference between the common electrode X and the scanning electrode Y is allowed to perform sustain discharge therebetween.

Now, explained in detail below are the pre-drive circuits 32-1 to 32-4 shown in FIG. 1. Incidentally, the pre-drive circuits 32-1 to 32-4 have the same configuration, and therefore only the pre-drive circuit 32-1 is described below.

Figure 3:
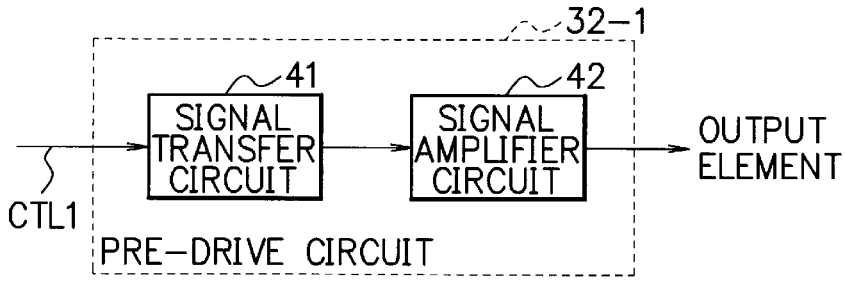
FIG. 3 is a block diagram showing the arrangement of a pre-drive circuit.

FIG. 3 is a block diagram showing the arrangement of a pre-drive circuit.

Referring to FIG. 3, the pre-drive circuit 32-1 comprises a signal transfer circuit 41 and a signal amplifier circuit 42.

The signal transfer circuit 41 converts the control signal, which is supplied from the drive control circuit 31 via the control line CTL1 with reference to the reference potential (e.g., the GND) of the drive control circuit 31 shown in FIG. 1, to a control signal having a potential level to match with the reference potential of an output element (the switch SW4 shown in FIG. 1 for the pre-drive circuit 32-1). For example, the signal transfer circuit 41 can be made up of photo-coupler (photo-isolators), coupling capacitors, or transformers.

The signal amplifier circuit 42 amplifies the control signal, which is outputted to the output element from the signal transfer circuit 41, to an output element drive level and then supplies the control signal to the output element. For example, the signal amplifier circuit 42 can be composed of MOS drivers or IGBT (Insulated Gate Bipolar Transistor) drivers.

The pre-drive circuit 32-1 configured as described above allows the signal transfer circuit 41 to convert the control signal, which is supplied from the drive control circuit 31 and employs, as the reference, the reference potential of the drive control circuit 31, to the potential level of the reference potential of the output element. Then, the signal amplifier circuit 42 amplifies the resulting signal to the drive level of the output element and thereafter supplies the resulting signal to the output element. This makes it possible to supply a control signal corresponding to the reference potential of the output element to the output element. Accordingly, the output element can be operated with stability, and variations in potential of the output element could be prevented from affecting the drive control circuit 31.

In addition, provided is the signal transfer circuit 41 for converting the reference potential of the control signal supplied. Upon designing circuits to be placed before and after the signal transfer circuit 41, this makes it possible to design the circuits separately without considering the respective reference potential, thereby facilitating the circuit design.

Figure 4:
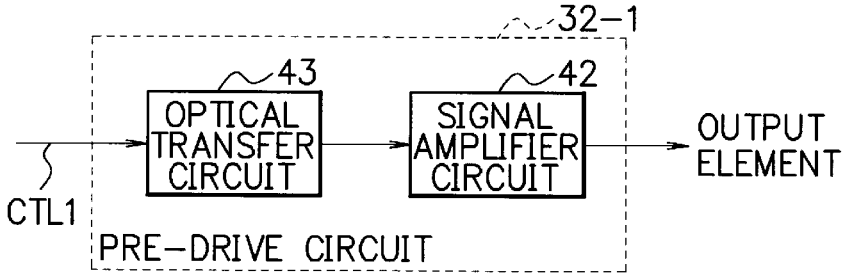
FIG. 4 is a block diagram showing another arrangement of a pre-drive circuit.

FIG. 4 is a block diagram showing another arrangement of a pre-drive circuit.

The pre-drive circuit 32-1 shown in FIG. 4 is that of FIG. 3 in which an optical transfer circuit 43 such as a photo-coupler (a photo-isolator) is employed as the signal transfer circuit 41 for converting the reference potential of the control signal supplied from the drive control circuit 31.

Figure 5:
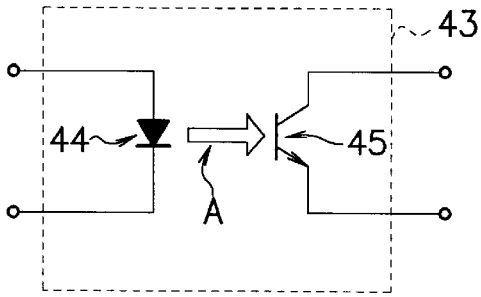
FIG. 5 is a view showing the arrangement of an optical transfer circuit.

Referring to FIG. 4, the optical transfer circuit 43 comprises a combination of a light-emitting element 44 and a light-receiving element 45 as shown in FIG. 5. Here, the reference potential of the light-emitting element 44 is equal to that of the drive control circuit 31, while the reference potential of the light-receiving element 45 is equal to that of the output element.

In the pre-drive circuit 32-1 shown in FIG. 4, a control signal supplied from the drive control circuit 31 to the output element causes the light-emitting element 44 in the optical transfer circuit 43 to flash in accordance with the control signal. Then, the light-receiving element 45 in the optical transfer circuit 43 detects the presence or absence of light A emitted from the light-emitting element 44, allowing the optical transfer circuit 43 to output a signal in accordance with the result of detection. That is, the optical transfer circuit 43 converts the reference potential of the supplied control signal from that of the drive control circuit 31 to that of the output element, and then outputs the resulting signal.

Then, the control signal converted to the reference potential of the output element for output by the optical transfer circuit 43 is amplified to the drive level of the output element by the signal amplifier circuit 42, being supplied to the output element.

Now, consider this case where the optical transfer circuit 43 converts the control signal from the reference potential of the drive control circuit 31 to that of the output element. In this case, it is possible to transfer the control signal by means of light between the light-emitting element 44 and the light-receiving element 45 in the optical transfer circuit 43, while the path for transferring the control signal is electrically isolated. Accordingly, variations in potential or the like caused in the output element would never exert an effect on the drive control circuit 31.

Figure 6:
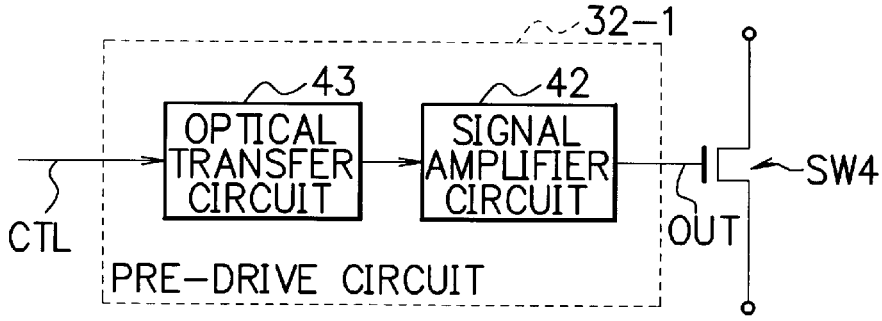
FIG. 6 is a view for expaining an operation of a pre-drive circuit.

FIG. 6 is a view for explaining an operation of the pre-drive circuit shown in FIG. 4.

Referring to FIG. 6, the switch SW4 acting as an output element is formed of an n-channel transistor. The switch SW4 is turned on at the high level of signal OUT outputted from the pre-drive circuit 32-1 and turned off at the low level.

In addition, the pre-drive circuit 32-1 outputs a high level signal OUT when the light-emitting element 44 in the optical transfer circuit 43 emits light and otherwise a low level signal OUT (when the light-emitting element 44 emits no light).

Figure 7:
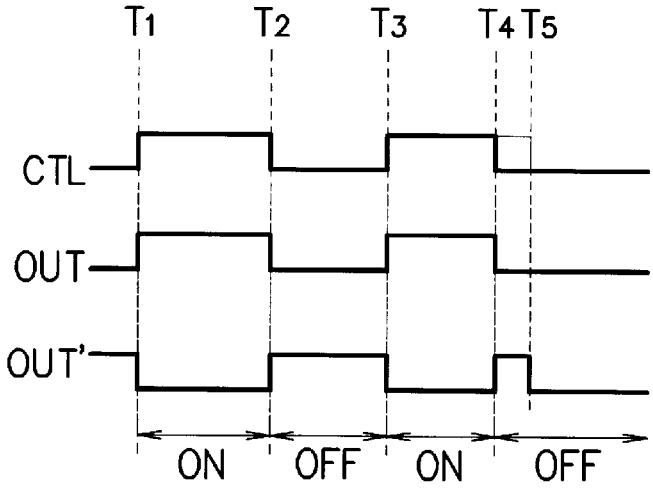
FIG. 7 is a timing chart showing the operation of a pre-drive circuit.

FIG. 7 is a timing chart showing the operation of the pre-drive circuit 32-1 shown in FIG. 6.

Referring to FIG. 7, CTL is a control signal supplied from the drive control circuit 31, and OUT is a signal outputted from the pre-drive circuit 32-1 in accordance with the control signal. In addition, OUT' is shown for the comparison with the signal OUT. The signal OUT' takes on the low level when the light-emitting element 44 in the optical transfer circuit 43 emits light and otherwise the high level (when the light-emitting element 44 emits no light).

Here, it is to be understood that the light-emitting element 44 in the optical transfer circuit 43 emits light with the control signal CTL being at the high level but emits no light at the low level.

First, at time T1, with the control signal CTL being at the high level, the light-emitting element 44 in the optical transfer circuit 43 emits light to cause the signal OUT outputted from the pre-drive circuit 32-1 to be at the high level and the switch SW4 to be brought into an "on" state. Then, at time T2, with the control signal CTL being at the low level, the light-emitting element 44 in the optical transfer circuit 43 emits no light to cause the signal OUT outputted from the pre-drive circuit 32-1 to be at the low level and the switch SW4 to be brought into an "off" state.

Then, at time T3, with the control signal CTL being brought again to the high level, the signal OUT outputted from the pre-drive circuit 32-1 is correspondingly brought to the high level, causing the switch SW4 to be brought into an "on" state.

Now, suppose that a failure or the like on the power supply device for supplying power or on a circuit interrupts power supply to the optical transfer circuit 43 in the pre-drive circuit 32-1 at time T4, and thereafter power supply to other circuits including the switch SW4 is shut off at time T5. In this case, at time T4, the light-emitting element 44 in the optical transfer circuit 43 would not emit light irrespective of the control signal CTL. Correspondingly, this causes the signal OUT outputted from the pre-drive circuit 32-1 to be brought to the low level and the switch SW4 to be brought into an "off" state.

In contrast, consider the case of the signal OUT' which is at the low level when the light-emitting element 44 in the optical transfer circuit 43 emits light and otherwise at the high level (when the light-emitting element 44 emits no light). In this case, at time T4, the light-emitting element 44 in the optical transfer circuit 43 will not emit light. However, since other circuits are still in action, the signal OUT' outputted from the pre-drive circuit 32-1 is brought to the high level and the switch SW4 is brought into an "on" state. Thereafter, at time T5, other circuits including the switch SW4 become out of action, thereby causing the switch SW4 to be brought into an "off" state.

That is, consider the case where the switch SW4 acting as an output element is in an "off" state while the light-emitting element 44 in the optical transfer circuit 43 is emitting light, and the switch SW4 is in an "on" state when the light-emitting element 44 is emitting no light. In this case, when power supply only to the optical transfer circuit 43 would be interrupted, the switch SW4 would be brought into an "on" state. In some cases, this may cause current to be continuously supplied to the plasma display panel or output elements such as switches, which should be exclusively controlled, to be brought into an "on" state simultaneously resulting in damage to the elements or the like.

In contrast, consider the case in which like the signal OUT, the switch SW4 acting as an output element is in an "on" state when the light-emitting element 44 in the optical transfer circuit 43 is emitting light, and the switch SW4 is in an "off" state when the light-emitting element 44 is emitting no light. Even when power supply only to the optical transfer circuit 43 is interrupted, it is possible to bring the switch SW4 into an "off" state and thereby positively prevent damage to the elements.

On the other hand, consider the case where a failure or the like on the power supply device for supplying power or on a circuit interrupts power supply to the optical transfer circuit 43. In this case, as a method for positively bringing the output element connected to the pre-drive circuit 32-1 into an "off" state, available is to employ a power supply potential sustaining circuit for supplying power to the optical transfer circuit 43 for a predetermined length of time.

Figure 8:
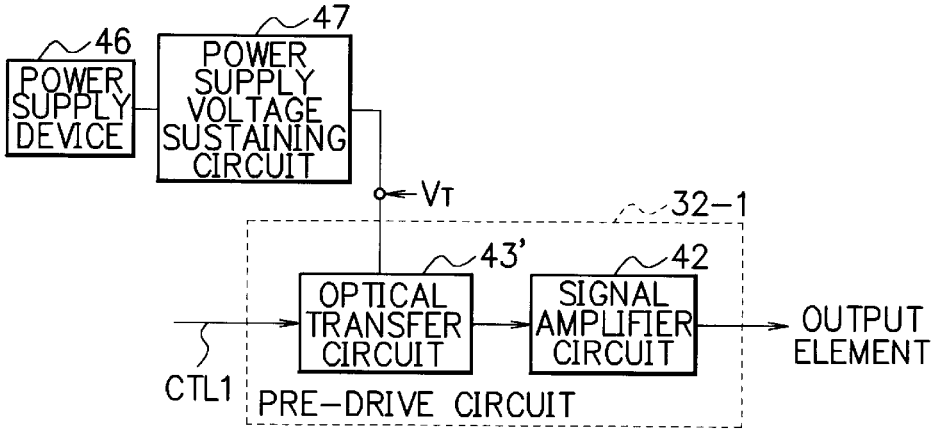
FIG. 8 is a block diagram showing another arrangement of a pre-drive circuit.

FIG. 8 is a block diagram showing the arrangement of the pre-drive circuit 32-1 in which the optical transfer circuit 43 is provided with the power supply potential sustaining circuit.

Figure 9:
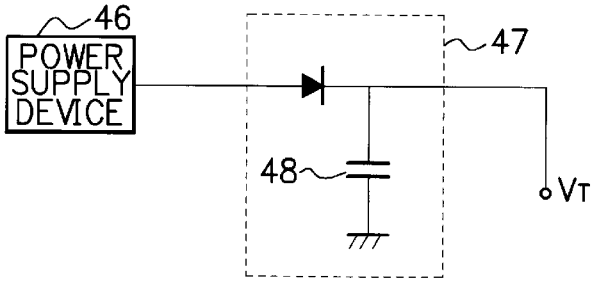
FIG. 9 is a view showing the arrangement of a supply potential sustainer circuit.

Referring to FIG. 8, reference numeral 46 designates a power supply device for supplying power to the optical transfer circuit 43' via a power supply potential sustaining circuit 47. In addition, when power supply from the power supply device 46 to the optical transfer circuit 43 is interrupted, the power supply potential sustaining circuit 47 supplies power to the optical transfer circuit 43 for a predetermined length of time via a power supply terminal $V_T$. For example, the power supply potential sustaining circuit 47 comprises a diode having the anode connected to the power supply device 46 and the cathode connected to the power supply terminal $V_T$ and a capacitor 48 connected between the cathode of the diode and the ground shown in FIG. 9.

In addition, when the power supply device 46 supplies power to the optical transfer circuit 43 via the power supply terminal $V_T$, the power being supplied is accumulated as charge in the capacitor 48. On the other hand, suppose that power supply from the power supply device 46 to the optical transfer circuit 43 is interrupted. In this case, the charges accumulated in the capacitor 48 are supplied to the optical transfer circuit 43 via the power supply terminal $V_T$, thereby sustaining the power supplied to the optical transfer circuit 43 for a predetermined length of time. Even when power supply to the optical transfer circuit 43 is interrupted, this makes it possible to sustain properly the logic of a signal outputted from the optical transfer circuit 43 until the power supply potential to be supplied to the output element is lowered and thereby prevent damage to elements or the like.

Incidentally, consider the case where the optical transfer circuit 43 is provided with the power supply potential sustaining circuit 47 as described above, and the output element is in an "off" state when the light-emitting element 44 in the optical transfer circuit 43 is emitting light. In this case, even when power supply to the optical transfer circuit 43 is interrupted, it is possible to allow the signal outputted from the optical transfer circuit 43 to sustain the output element in an "off" state until the power supply potential to be supplied to the output element is lowered.

Figure 10:
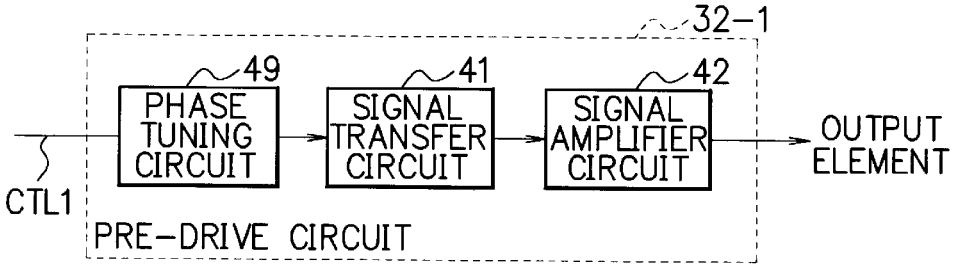
FIG. 10 is a block diagram showing another arrangement of a pre-drive circuit.

FIG. 10 is a block diagram showing another arrangement of the pre-drive circuit 32-1.

The pre-drive circuit 32-1 shown in FIG. 10 is the pre-drive circuit shown in FIG. 3 that is further provided with a phase tuning circuit 49.

Referring to FIG. 10, the phase tuning circuit 49 adjusts the phase delay of a control signal, which is supplied from the drive control circuit 31 to an output element via the pre-drive circuit 32-1, among the pre-drive circuits 32-1 to 32-4.

That is, the signal transfer circuit 41 converts the reference potential for the control signal supplied from the drive control circuit 31 or the signal amplifier circuit 42 amplifies the control signal. At this time, a delay develops in the phase of the resulting signal outputted from the pre-drive circuit due to variations in elements constituting the signal transfer circuit 41 and the signal amplifier circuit 42 or in sensitivity of the elements or the like.

The phase tuning circuit 49 adjusts the phase delay developed in the signal transfer circuit 41 and the signal amplifier circuit 42 among pre-drive circuits 32-1–32-4 in order to supply the control signals in phase with each other to the respective output elements.

For example, the optical transfer circuit 43 can be made up of a time constant tuning circuit having a capacitor and a resistor, making it possible to adjust phase delays by tuning the capacitance of the capacitor and the resistance of the resistor.

Figure 11A:
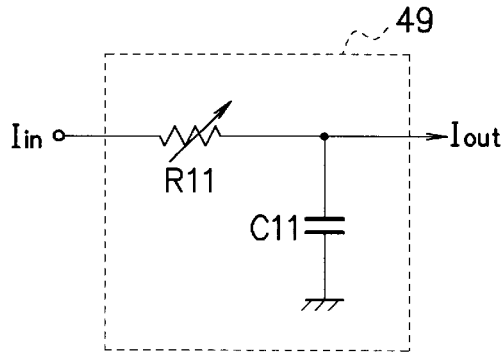
FIGS. 11A, 11B, and 11C are views showing the arrangements of a phase tuning circuit.
Figure 11B:
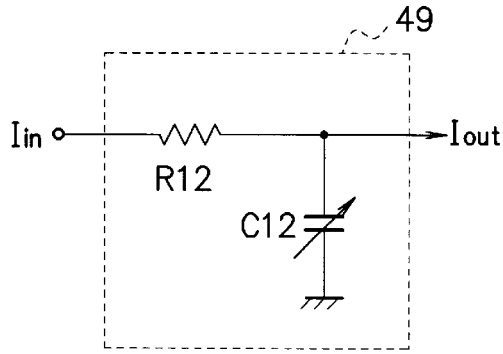
Figure 11C:
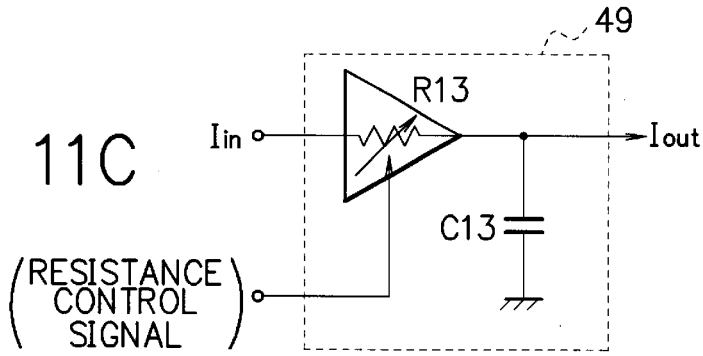

FIGS. 11A, 11B, and 11C are views showing the arrangement of the phase tuning circuit 49.

In FIGS. 11A, 11B, and 11C, Iin designates an input terminal of the phase tuning circuit 49 and Iout designates an output terminal of the phase tuning circuit 49.

The phase tuning circuit 49 shown in FIG. 11A comprises a variable resistor R11 connected between the input terminal Iin and the output terminal Iout, and a capacitor C11 connected between the GND and an interconnection node of the output terminal Iout and the terminal of the variable resistor R11. The resistance of the variable resistor R11 is varied, thereby tuning the phase delay time.

The phase tuning circuit 49 shown in FIG. 11B comprises a resistor R12 connected between the input terminal Iin and the output terminal Iout, and a variable capacitor C12 connected between the GND and an interconnection node of the output terminal Iout and the terminal of the resistor R12. The capacitance of the variable capacitor C12 is varied, thereby tuning the phase delay time.

The phase tuning circuit 49 shown in FIG. 11C comprises an electronic volume R13, connected between the input terminal Iin and the output terminal Iout, for varying resistance electrically, and a capacitor C13 connected between the GND and an interconnection node of the output terminal Iout and the terminal of the electronic volume R13. In addition, a resistance control signal for tuning the electronic volume R13 is input externally and supplied to the electronic volume R13. Then, the resistance control signal is allowed to vary the resistance of the electronic volume R13, thereby tuning the phase delay time.

As described above, the phase tuning circuit 49 is provided in the pre-drive circuit. This makes it possible to adjust the phase delay caused by elements constituting the signal transfer circuit 41 and the signal amplifier circuit 42 or the like and thereby stabilize the operation of the output elements.

Incidentally, the pre-drive circuit 32-1 shown in FIG. 10 is provided with the phase tuning circuit 49 before the signal transfer circuit 41. However, the phase tuning circuit 49 may be provided after the signal transfer circuit 41.

Figure 12:
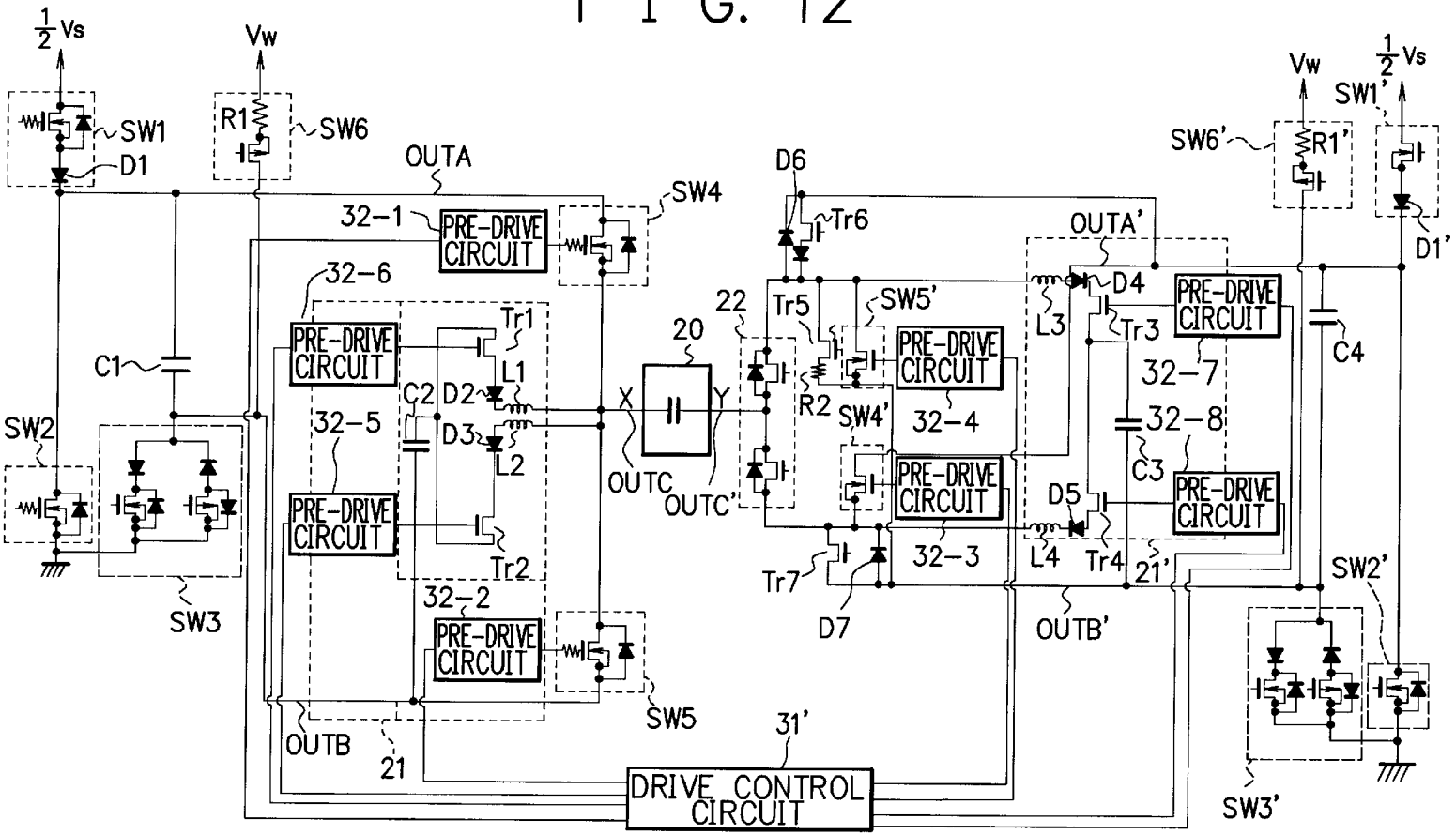
FIG. 12 is a view showing another arrangement of a drive circuit for an AC-driven PDP according to the first embodiment.
Figure 19:
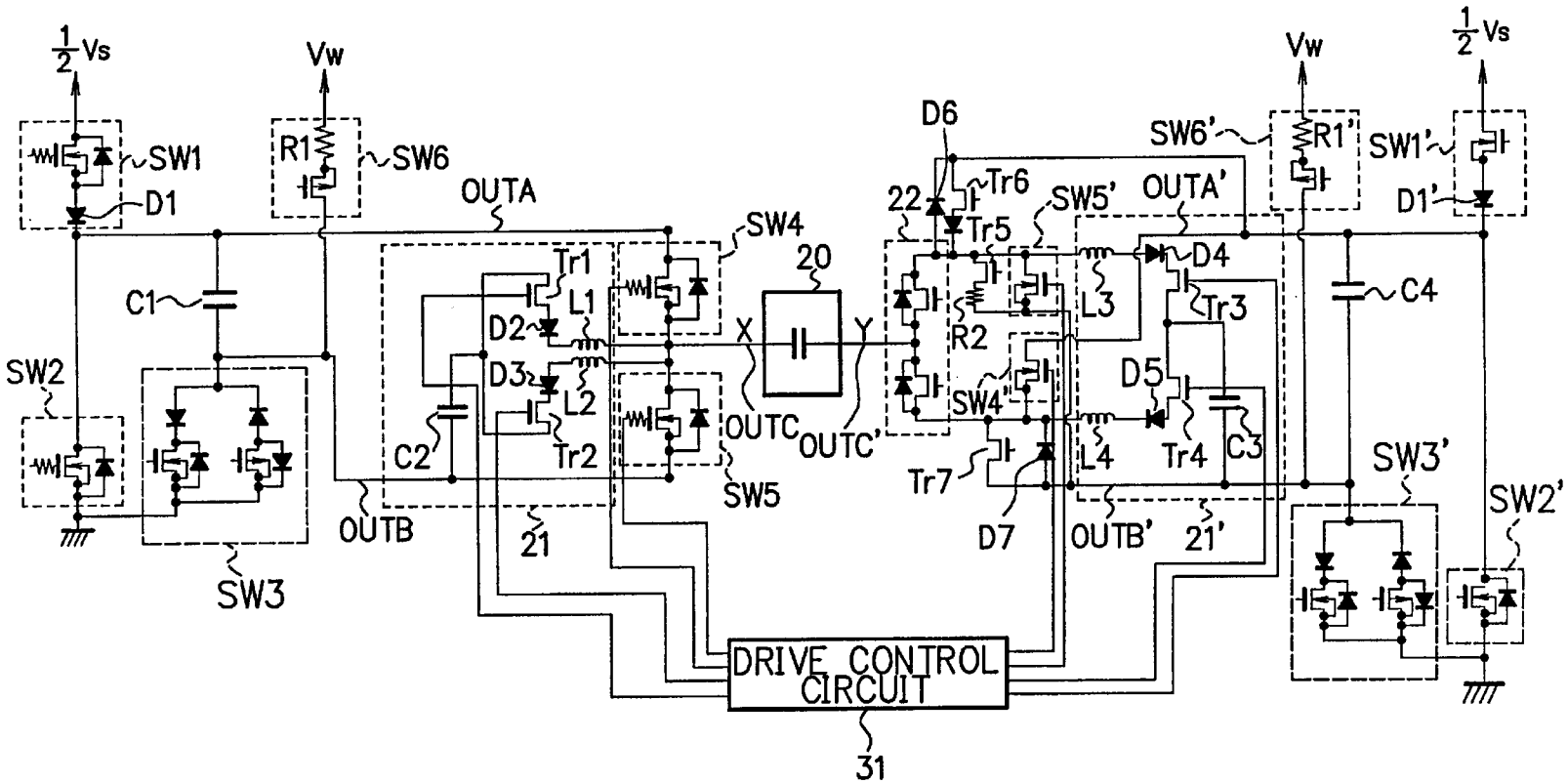
FIG. 19 PRIOR ART
FIG. 19 is a circuit diagram showing the arrangement of a drive circuit for an AC-driven PDP.
Figure 20:
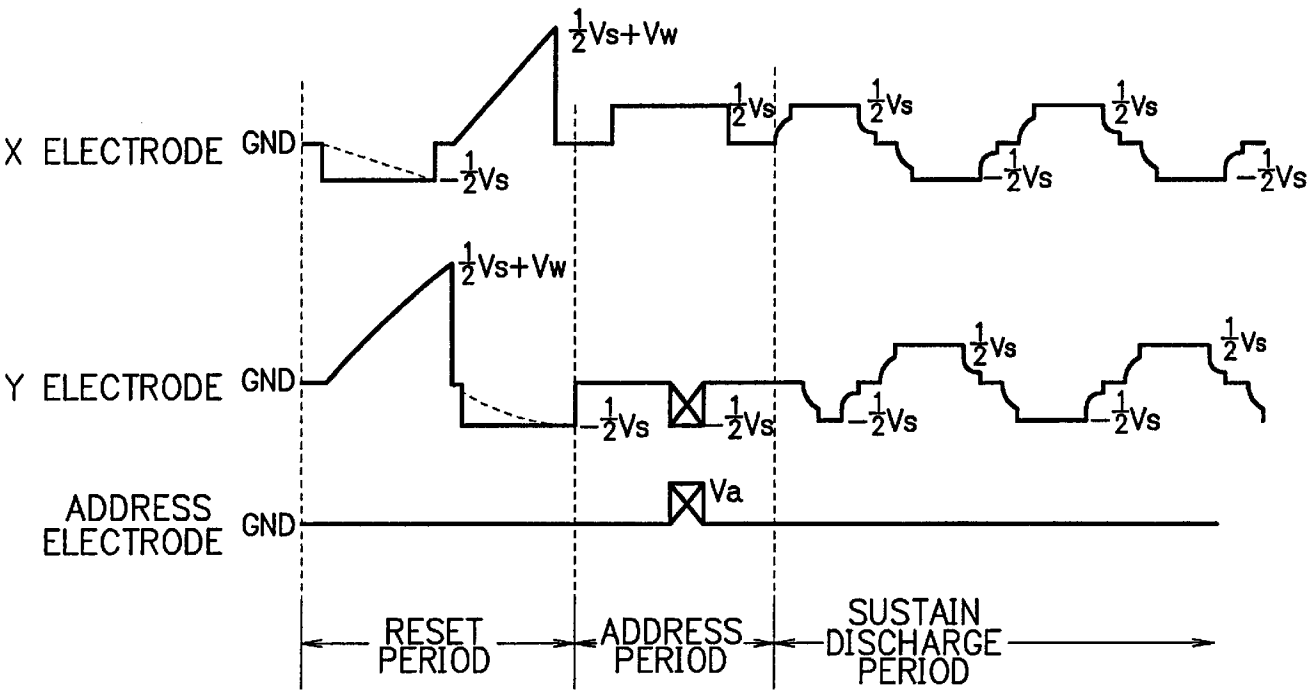
FIG. 20 PRIOR ART
FIG. 20 is a timing chart showing drive waveforms provided by the drive circuit for the AC-driven PDP shown in FIG. 19.

FIG. 12 is a view showing another arrangement of a drive circuit for an AC-driven PDP according to the first embodiment. The drive circuit shown in FIG. 12 is the drive circuit shown in FIG. 19 that is provided with a pre-drive circuit according to this embodiment. Incidentally, in FIG. 12, the same components as those shown in FIG. 19 are given the same reference symbols and will not be explained repeatedly.

Referring to FIG. 12, reference symbols 32-1 to 32-8 designate pre-drive circuits. The pre-drive circuits 32-1 to 32-8 convert and supply the potential level of control signals, each of which is supplied from the drive control circuit 31', with reference to the reference potential of the switches SW4, SW5, SW4', and SW5', and the transistors Tr1 to Tr4. That is, like the pre-drive circuits shown in FIG. 1, the pre-drive circuits 32-1 to 32-8 convert the reference potential of the control signals, each supplied from the drive control circuit 31', from that of the drive control circuit 31' to that of the output elements, and then supply the resulting control signals to the output elements.

Since the reference potential of the switches SW4, SW5, SW4', and SW5', and the transistors Tr1 to Tr4 varies in the drive operation, the drive circuit shown in FIG. 12 is provided with the pre-drive circuits 32-1 to 32-8.

As described above, the pre-drive circuits 32-1 to 32-8 are each provided for the respective switches SW4, SW5, SW4', and SW5', and the transistors Tr1 to Tr4, which vary in reference potential in the drive operation. This makes it possible to supply control signals with reference to the reference potential to the respective switches SW4, SW5, SW4', and SW5', and the transistors Tr1 to Tr4, thereby allowing each of the output elements to operate with stability.

Incidentally, any of the pre-drive circuits can be employed as the pre-drive circuits 32-1 to 32-8 shown in FIG. 12.

As described above, this embodiment allows the signal transfer circuit 41 in the pre-drive circuit to convert the reference potential of the control signals supplied from the drive control circuit 31 to that of output elements (such as switches SW4, SW5, SW4', and SW5', and the transistors Tr1 to Tr4), and allows the signal amplifier circuit 42 to amplify the resulting signals and then output to the output elements.

Even when the reference potential of the drive control circuit 31 and the control signal is different from that of the output element, this makes it possible to isolate the reference potential and transfer the control signal to the output element. Accordingly, variations in potential of the output element or the like could be prevented from affecting the drive control circuit 31. This makes it possible to drive the plasma display device with stability and thereby provide improved reliability for the plasma display device.

For example, suppose that the optical transfer circuit 43 is employed as the signal transfer circuit 41. In this case, an electrical path can be completely shut off while the control signal is being transferred between the drive control circuit 31 and the output element. Even when variations in potential of the output element or the like occur, this makes it possible to perfectly prevent the drive control circuit 31 from being affected, thereby providing further improved reliability to the plasma display device.

In addition, for example, suppose that the phase tuning circuit 49 is provided in the pre-drive circuit. In this case, it is possible to adjust the phase delay caused by the signal transfer circuit 41, the signal amplifier circuit 42 or the like upon converting the control signal to the reference potential of the output element. Accordingly, the operation timing of each of the output elements can be synchronized, thereby making it possible to drive the plasma display device with stability.

[Second Embodiment]

Now, the present invention will be explained with reference to a second embodiment.

Figure 13:
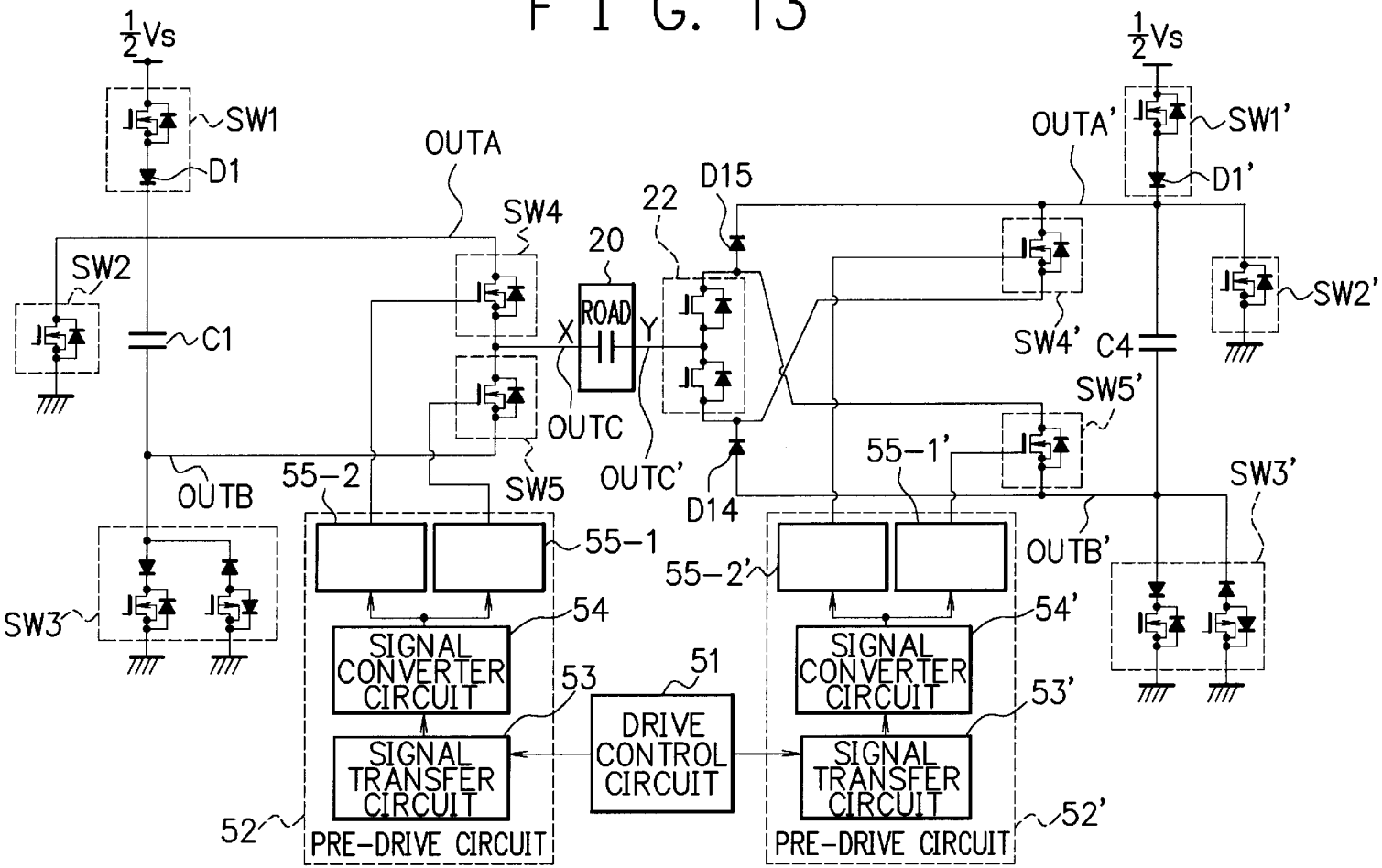
FIG. 13 is a circuit diagram showing the arrangement of a drive circuit for an AC-driven PDP according to the second embodiment.

FIG. 13 is a circuit diagram showing the arrangement of a drive circuit for an AC-driven PDP according to the second embodiment. Incidentally, the drive circuit shown in FIG. 13 according to this embodiment is applicable to the AC-driven PDP device shown in FIGS. 17 and 18, in which illustrated are the overall arrangement thereof and the structure of a cell constituting the pixel. Incidentally, in FIG. 13, the same components as those shown in FIG. 1 are given the same reference symbols and will not be explained repeatedly.

The drive circuit according to the first embodiment is provided with one pre-drive circuit for each of the output element. However, the drive circuit according to the second embodiment is provided with one pre-drive circuit on each side of the common electrode X and the scanning electrode Y for conversion and generation of control signals for each of the output elements or the like in the pre-drive circuit to supply the resulting signal to each of the output elements.

In FIG. 13, reference numeral 51 designates a drive control circuit, and 52 and 52' designate a pre-drive circuit. The drive control circuit 51 supplies a control signal to each of the pre-drive circuits 52, 52'. Incidentally, the control signal controls all the output elements (switches SW4, SW5, SW4', and SW5') connected after each of the pre-drive circuits 52 and 52'.

The pre-drive circuit 52 comprises a signal transfer circuit 53, a signal converter circuit 54, and signal amplifier circuits 55-1 and 55-2 equal in number to the output elements (two on the common electrode X side shown in FIG. 13).

The signal transfer circuit 53 converts the reference potential of the control signal, supplied from the drive control circuit 51, to that of the output element for output. That is, the signal transfer circuit 53 converts the control signal, which is supplied from the drive control circuit 51 with reference to the reference potential (e.g., the GND) of the drive control circuit 51, to a control signal having a potential level to match with the reference potential of an output element connected after the pre-drive circuit 52. For example, the signal transfer circuit 53 can be made up of photo-couplers (photo-isolators), coupling capacitors, or transformers.

The signal converter circuit 54 generates control signals for each of the output elements connected after the pre-drive circuit 52 in accordance with the control signal having the potential level converted by the signal transfer circuit 53 to the reference potential of the output element. Then, the signal converter circuit 54 supplies the resulting control signals to the signal amplifier circuits 55-1 and 55-2 with an appropriate timing. In other words, the signal converter circuit 54 generates two control signals for the switches SW4 and SW5 connected after the pre-drive circuit 52 in accordance with the control signal having the potential level converted by the signal transfer circuit 53 to the reference potential of the output element. Then, the signal converter circuit 54 supplies the resulting control signals to the signal amplifier circuits 55-1 and 55-2, respectively.

The signal amplifier circuits 55-1 and 55-2 amplify the control signals separated and supplied by the signal converter circuit 54 up to the drive level of output elements, and then supply the resulting control signals to the switches SW4 and SW5 acting as output elements.

The pre-drive circuit 52' on the scanning electrode Y side is constituted in the same way as the pre-drive circuit 52 on the common electrode X side and is not explained repeatedly.

Figure 14:
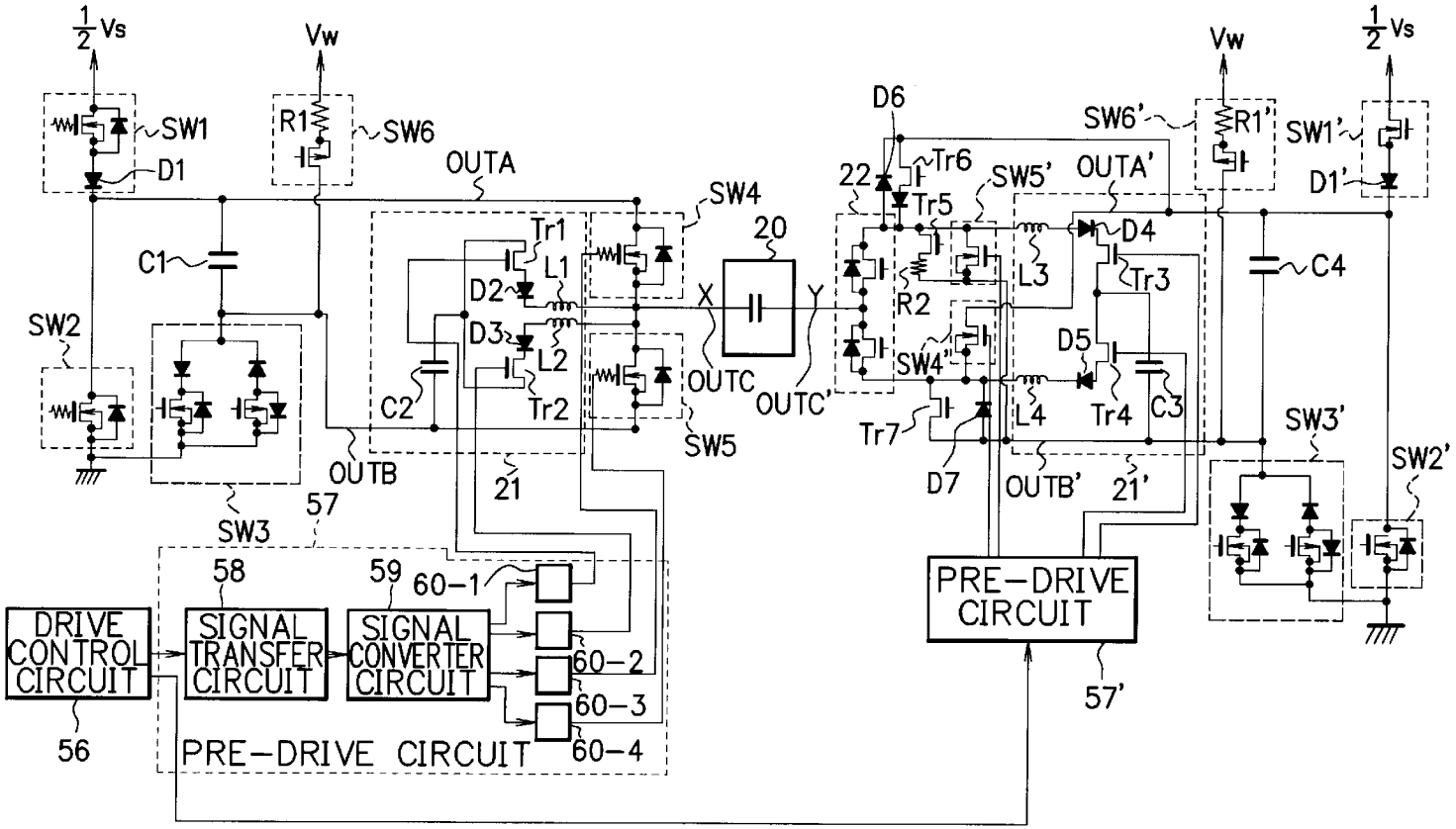
FIG. 14 is a circuit diagram showing another arrangement of a drive circuit for an AC-driven PDP according to the second embodiment.

FIG. 14 is a circuit diagram showing another arrangement of a drive circuit for an AC-driven PDP according to the second embodiment. Incidentally, in FIG. 14, the same components as those shown in FIGS. 12 and 19 are given the same reference symbols and will not be explained repeatedly.

Like the drive circuit shown in FIG. 13 which has a power recovering circuits 21 and 21', the drive circuit shown in FIG. 14 is provided with one pre-drive circuit on each of the scanning electrode X side and the scanning electrode Y side, for conversion and generation of control signals for each of the output elements in the pre-drive circuit to supply the resulting signal to each of the output elements.

Referring to FIG. 14, reference number 56 designates a drive control circuit, and 57 and 57' designate pre-drive circuits, which have the same functions as those of the drive control circuit 51 and the pre-drive circuits 52 and 52', shown in FIG. 13.

The pre-drive circuit 57 comprises a signal transfer circuit 58, a signal converter circuit 59, and signal amplifier circuits 60-1, 60-2, 60-3, and 60-4 equal in number to the output elements (four on the common electrode X side shown in FIG. 14).

Like the signal transfer circuit 53 shown in FIG. 13, the signal transfer circuit 58 converts the reference potential of the control signal, supplied from the drive control circuit 56, to that of the output element to output the resulting control signal to the signal converter circuit 59.

Like the signal converter circuit 54 shown in FIG. 13, the signal converter circuit 59 generates control signals for each of the output elements connected after the pre-drive circuit 57 in accordance with the control signal having the potential level converted by the signal transfer circuit 58 to the reference potential of the output element. Then, the signal converter circuit 59 supplies the resulting control signals to the signal amplifier circuits 60-1 to 60-4 with an appropriate timing. In other words, the signal converter circuit 59 generates four control signals for each of the switches SW4 and SW5 and the transistors Tr1 and Tr2 connected after the pre-drive circuit 57 in accordance with the control signal having the potential level converted by the signal transfer circuit 58 to the reference potential of the output element. Then, the signal converter circuit 59 supplies the resulting control signals to the signal amplifier circuits 60-1 to 60-4, respectively.

The signal amplifier circuits 60-1 to 60-4 amplify the control signals, each separated and supplied by the signal converter circuit 59, to the drive level of the output element and then supply the resulting control signals to the switches SW4 and SW5, acting as output elements, and the transistors Tr1 and Tr2, respectively.

Incidentally, the pre-drive circuit 57' on the scanning electrode Y side has the same configuration as that of the pre-drive circuit 57.

As described above, the second embodiment is provided with one pre-drive circuit on each side of the common electrode X and the scanning electrode Y. The signal converter circuit connected after the signal transfer circuit in the pre-drive circuit separates the control signals supplied to those for each of the output elements connected to the pre-drive circuit and then supplies the resulting controls signal to the output elements.

In comparison with the drive circuit provided with one pre-drive circuit for each output element, this makes it possible to isolate the reference potential of the control signal from that of the output element with a less number of signal transfer circuits to transmit the resulting control signal to the output element. Thus, only with the addition of a few circuits, the plasma display device can be driven with stability, thereby making it possible to provide improved reliability for the plasma display device.

[Third Embodiment]

Now, the present invention will be described with reference to a third embodiment.

Figure 15:
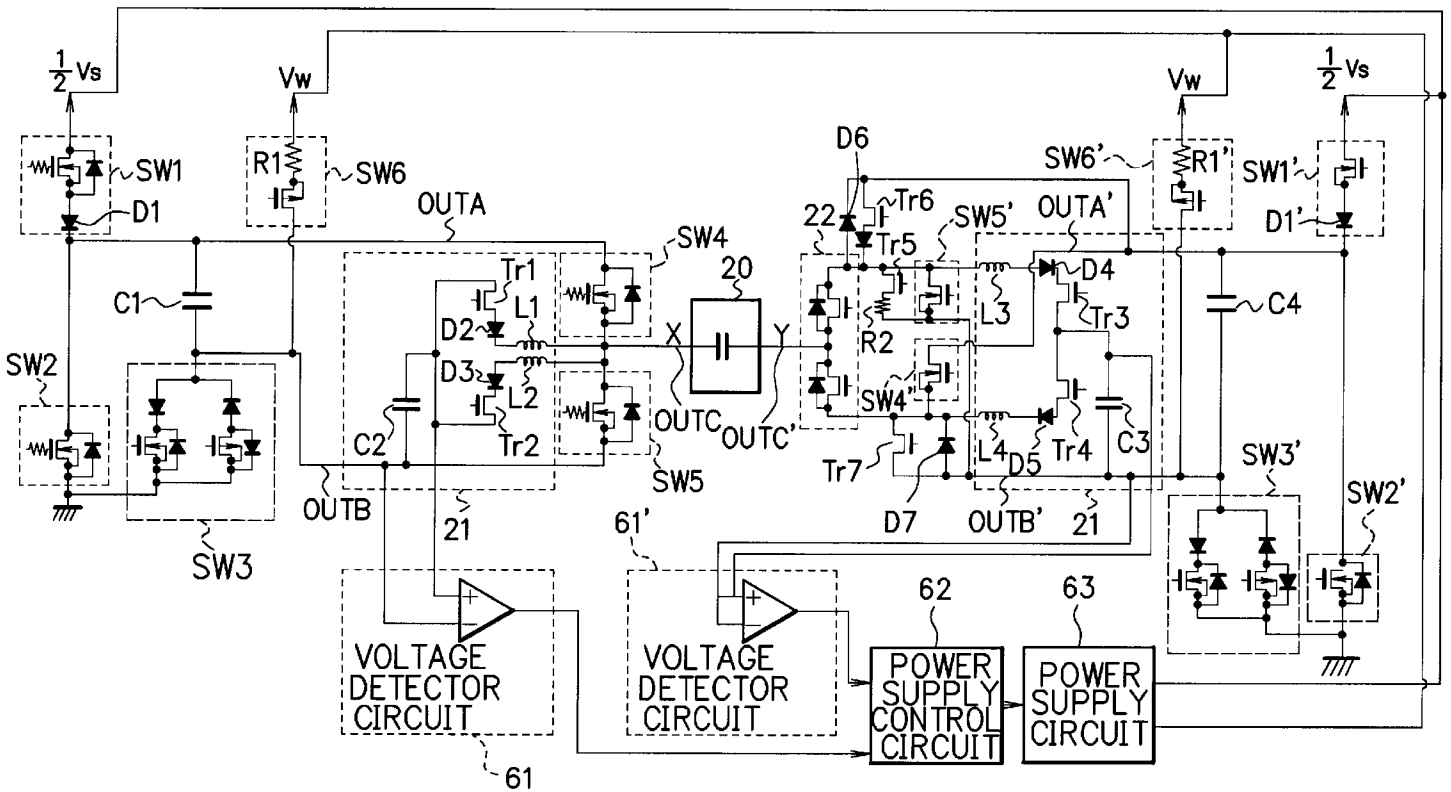
FIG. 15 is a circuit diagram showing the arrangement of a drive circuit for an AC-driven PDP according to the third embodiment.

FIG. 15 is a circuit diagram showing the arrangement of a drive circuit for an AC-driven PDP according to the third embodiment. Incidentally, in FIG. 15, the same components as those shown in FIG. 19 are given the same reference symbols and will not be explained repeatedly.

Referring to FIG. 15, potential detector circuits, designated by reference numerals 61 and 61', detect the potential difference between the electrodes of the capacitors C2 and C3 provided in the power recovery circuits 21 and 21', and then supplies the results of detection to a power supply control circuit 62.

The power supply control circuit 62 determines whether each of the power recovery circuits 21 and 21' works properly, in accordance with the results of detection of the potential difference between the electrodes of the capacitors C2 and C3 supplied from the potential detector circuits 61 and 61'. In other words, the power supply control circuit 62 determines whether the potential difference between the electrodes of the capacitors C2 and C3, that is, the result of detection supplied from the potential detector circuits 61 and 61' is indicative of the properly operating power recovery circuits 21 and 21'.

Figure 16:
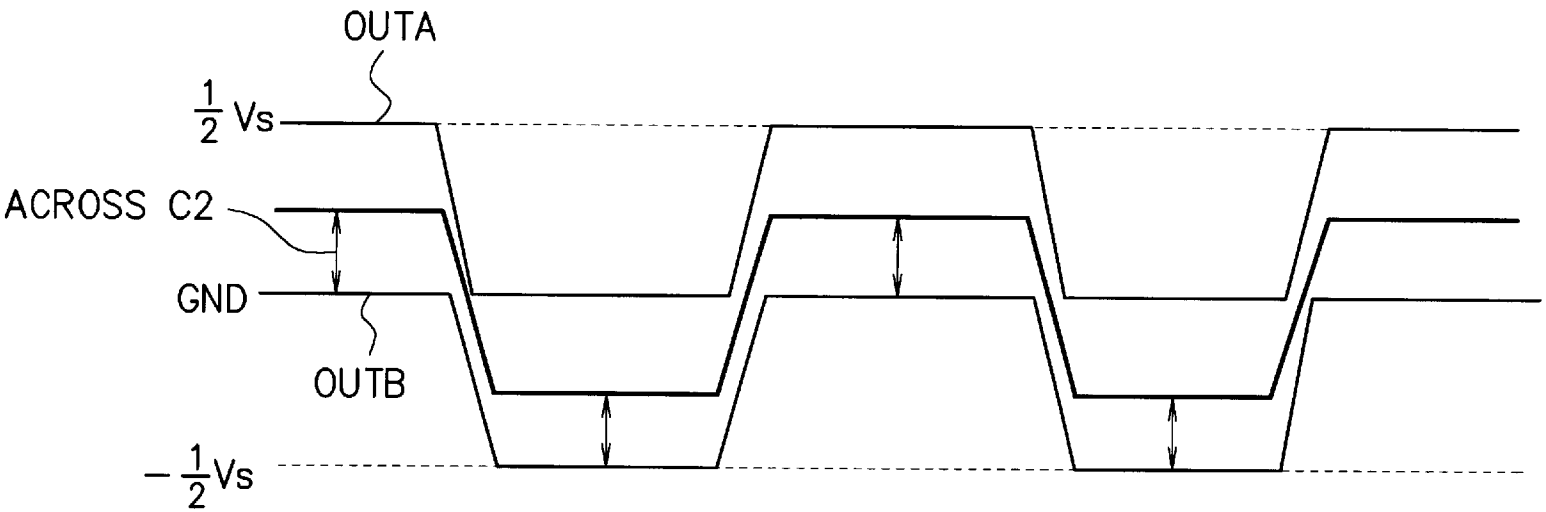
FIG. 16 is a potential waveform diagram for explaining the operation of a drive circuit for an AC-driven PDP according to the third embodiment.

Now, for example, suppose that the power recovery circuit 21 operates properly. In this case, the potential difference across the capacitor C2 (the potential difference between the second signal line OUTB and the interconnection node of the transistor Tr1 and Tr2) is Vs/4 as shown in FIG. 16. Accordingly, the determination is made based on a determination of whether the potential detector circuits 61 and 61' supply Vs/4 as the potential difference between the electrodes of the capacitors C2 and C3.

Suppose that it has been determined consequently that at least one of the power recovery circuits 21 and 21' works improperly, that is, the result of detection supplied from the potential detector circuits 61 and 61' is different from the value indicative of the properly operating power recovery circuits 21 and 21'. In this case, the power supply control circuit 62 controls a power supply circuit 63 to lower the output potentials Vs/2 and Vw.

As described above, according to the third embodiment, detected is the potential difference between the electrodes of the capacitors C2 and C3 provided for each of the power recovery circuits 21 and 21'. When it has been determined that the result of detection is different from the value indicative of the properly operating power recovery circuits 21 and 21', the output potential supplied to the plasma display device is lowered. This makes it possible to stop the operation of the plasma display device before the occurrence of damage to the elements, thereby providing improved reliability for the plasma display device.

Incidentally, as the present invention may be embodied in several forms without departing from the scope of essential characteristics thereof, it is to be understood that the embodiments, although having been described specifically, are therefore illustrative and not restrictive.

As described above, according to the present invention, a signal transfer circuit converts a control signal, for controlling an output element that supplies a potential to an electrode for applying a potential to a display cell to perform discharge therein, to a signal having the reference potential of the output element and then supplies the resulting signal to the output element. This makes it possible to transfer the control signal with the reference potential being isolated, thereby providing improved reliability for the plasma display device.

A power recovery potential detected by a potential detector circuit for detecting the power recovery potential of a power recovery circuit may be different from the power recovery potential indicative of the properly operating power recovery circuit. When the power supply potential for driving the plasma display device is lowered at this time, the operation of the plasma display device can be stopped before the occurrence of damage to the elements. Accordingly, the plasma display device can be provided with improved reliability.

What is claimed is:

1. A plasma display device, comprising:

a first signal line supplying a voltage at a first level to one side of a load;

a second signal line supplying a voltage at a second level to said one side of said load;

a load driving circuit supplying the voltage at said first level to said load through said first signal line, in a state that the voltage of said second signal line is set at a third level while the voltage of said first signal line is set at said first level, and supplying the voltage at said second level to said load through said second signal line, in a state that the voltage of said first signal line is set at said third level while the voltage of said second signal line is set at said second level;

an output element provided between said first and second signal lines supplying the voltage at said first level, provided through said first signal line, or the voltage at said second level, provided through said second signal line, to said load; and a signal transfer circuit converting a reference potential of a control signal, which is output from a drive control circuit for controlling said output element, to a signal at a reference potential of said output element and supplying the resultant signal to said output element.

2. The device according to claim 1, wherein said signal transfer circuit is an optical transfer circuit.

3. The device according to claim 2, wherein said optical transfer circuit comprises a light-emitting element flashing in accordance with said control signal and a light-receiving element for detecting a light emitted by said light-emitting element.

4. The device according to claim 3, wherein said optical transfer circuit activates said output element when said light-receiving element has detected a light emitted by said light-emitting element.

5. The device according to claim 2, wherein said optical transfer circuit is a photo-coupler.

6. The device according to claim 2, further comprising a power supply potential sustaining circuit for accumulating externally supplied power signals and for supplying the accumulated power signals to said optical transfer circuit upon interruption of the external power supply.

7. The device according to claim 6, wherein said optical transfer circuit comprises a light-emitting element flashing in accordance with said control signal and a light-receiving element for detecting a light emitted by said light-emitting element, and the operation of said output element is prohibited when said light-receiving element has detected a light emitted by said light-emitting element.

8. The device according to claim 2, further comprising a power supply potential sustaining circuit, connected to a power supply terminal of said optical transfer circuit, for accumulating externally supplied power signals and for supplying the accumulated power signals to said optical transfer circuit upon interruption of the external power supply.

9. The device according to claim 1, further comprising a phase tuning circuit for tuning a delay of a control signal converted into a signal at said reference potential of said output element and supplied to said output element.

10. The device according to claim 9, wherein said phase tuning circuit is a time constant tuning circuit comprising a resistor and a capacitor and capable of changing at least one of the resistance of said resistor and the capacitance of said capacitor.

11. The device according to claim 1, wherein said control signal is capable of controlling a plurality of output elements, and said plasma display device comprises a signal converter circuit for separating said control signal into control signals for each of said plurality of output elements.

12. A method for controlling a plasma display device, wherein:

a voltage of a first signal line is changed between a first level and a second level while a voltage of a second signal line is changed between said second level and a third level, the voltage at said first level supplied by said first signal line or the voltage at said second level supplied by said second signal line, in a state that the voltage of said first signal line is set at said first level and the voltage of said second signal line is set at said second level, and the voltage at said third level supplied by said second signal line or the voltage at said second level supplied by said first signal line, in a state that the voltage of said second signal line is set at said third level and the voltage of said first signal line is set at said second level, are selectively supplied to a load; and a control signal, which is output from a drive control circuit for controlling an output element supplying each of said voltages selectively to said load, is converted into a signal at a reference potential of said output element, and the resultant signal is supplied to said output element.

13. The method according to claim 12, wherein said plasma display device further comprises a light-emitting element flashing in accordance with said control signal and a light-receiving element for detecting a light emitted by said light-emitting element, and the method further comprises the step of activating said output element when said light-receiving element has detected a light emitted by said light-emitting element.

* * * * *